US008992705B2

(12) United States Patent
Furukawa et al.

(10) Patent No.: US 8,992,705 B2
(45) Date of Patent: Mar. 31, 2015

(54) MICROCRYSTALLINE ALLOY, METHOD FOR PRODUCTION OF THE SAME, APPARATUS FOR PRODUCTION OF THE SAME, AND METHOD FOR PRODUCTION OF CASTING OF THE SAME

(75) Inventors: Yuichi Furukawa, Toyota (JP); Yoshiki Tsunekawa, Nagoya (JP)

(73) Assignees: Toyota Jidosha Kabushiki Kaisha, Aichi-ken (JP); Toyota School Foundation, Aichi-Ken (JP)

( * ) Notice: Subject to any disclaimer, the term of this patent is extended or adjusted under 35 U.S.C. 154(b) by 82 days.

(21) Appl. No.: 13/392,696

(22) PCT Filed: Aug. 2, 2010

(86) PCT No.: PCT/IB2010/001891
§ 371 (c)(1),
(2), (4) Date: Feb. 27, 2012

(87) PCT Pub. No.: WO2011/024040
PCT Pub. Date: Mar. 3, 2011

(65) Prior Publication Data

US 2012/0168040 A1 Jul. 5, 2012

(30) Foreign Application Priority Data

Aug. 27, 2009 (JP) ..... 2009-197167

(51) Int. Cl.
*B22D 17/00* (2006.01)
*C22F 3/00* (2006.01)
(Continued)

(52) U.S. Cl.
CPC . *C22F 3/00* (2013.01); *C22C 21/02* (2013.01); *C22C 21/06* (2013.01); *C22C 23/04* (2013.01); *C22F 1/043* (2013.01); *C22F 1/047* (2013.01); *C22F 3/02* (2013.01)
USPC ..... 148/538; 148/437; 266/233

(58) Field of Classification Search
CPC ..... C22C 1/02; C22C 1/026; C22C 1/0416
USPC ..... 148/437, 538; 266/233
See application file for complete search history.

(56) References Cited

FOREIGN PATENT DOCUMENTS

JP 51-092709 A 8/1976
JP 06-002056 A 1/1994
(Continued)

OTHER PUBLICATIONS

Abramov V et al: "Solidification of aluminium alloys under ultrasonic irradiation using water-cooled resonator", Materials Letters, North Holland Publishing Company, Amsterdam, NL, vol. 37, No. 1-2, Sep. 1, 1998, pp. 27-34, XP004255985, ISSN: 0167-577x, DOI:10.1016/S0167-577X(98)0064-0.
(Continued)

*Primary Examiner* — Kaj K Olsen
*Assistant Examiner* — Alexander Polyansky
(74) *Attorney, Agent, or Firm* — Sughrue Mion, PLLC

(57) ABSTRACT

During a process of cooling a hypereutectic Al—Si alloy melt, ultrasonic vibration is applied to the melt to crystallize primary crystal α-Al using, in combination, an ultrasonic transducer (8) that generates the ultrasonic vibration, an ultrasonic horn (7) that is connected to the ultrasonic transducer (8) and transmits the ultrasonic vibration in a specified direction, a treatment vessel (2) that holds the melt and is in contact with the ultrasonic horn (7), and a treatment vessel fixing device (3) that fixes the treatment vessel (2) by pressing the treatment vessel toward the ultrasonic horn (7).

6 Claims, 9 Drawing Sheets

(51) Int. Cl.

| | |
|---|---|
| ***C22C 21/02*** | (2006.01) |
| ***C22C 21/06*** | (2006.01) |
| ***C22C 23/04*** | (2006.01) |
| ***C22F 1/043*** | (2006.01) |
| ***C22F 1/047*** | (2006.01) |
| ***C22F 3/02*** | (2006.01) |
| *C22C 21/00* | (2006.01) |
| *C21C 7/00* | (2006.01) |

(56) References Cited

FOREIGN PATENT DOCUMENTS

| | | | |
|---|---|---|---|
| JP | 07-090459 | A | 4/1995 |
| JP | 07-278692 | A | 10/1995 |
| JP | 11-090615 | A | 4/1999 |
| JP | 2004-209487 | A | 7/2004 |
| JP | 2006-037190 | A | 2/2006 |
| JP | 2006-102807 | A | 4/2006 |
| JP | 2008-200692 | A | 9/2008 |
| JP | 2008-272819 | A | 11/2008 |

OTHER PUBLICATIONS

Eskin<1> G I: "Broad prospects for commercial applicationof the ultrasonic (cavitation) melt treatment of light alloys", Ultrasonics: Sonochemistry, Butterworth-Heinemann, GB, vol. 8, No. 3, Jul. 1, 2001, pp. 319-325, XP004245625, ISSN: 1350-4177, DOI: DOI:10.1016/S1350-4177(00)00074-2.

Feng H K et al: "Effect of ultrasonic treatment on microstructures of hypereutectic Al—Si alloy", Journal of Materials Processing Technology, Elsevier, NL, vol. 208, No. 1-3, Nov. 21, 2008, pp. 330-335, XP025469035, ISSN: 0924-0136, DOI: DOI:10.1016/J.JMATPROTEC.2007.12.121.

International Search Report and Written Opinion for corresponding International Patent Application No. PCT/IB2010/001891 mailed Jan. 28, 2011.

Japanese Office Action for corresponding JP Patent Application No. 2009-197167 drafted Nov. 18, 2011.

Journal of Japan Foundry Engineering Society: "Crystallization of Non-Equilibrium a-Aluminum Solid Solution in Al-18mass%Si alloy through Acoustic Cavitation", vol. 81, No. 10 (2009), pp. 469-474, issued on Oct. 25, 2009.

Aluminium-Zentrale, Dusseldorf (Publisher); W. Hufnagel, Unter Mitarbeit Zahlreicher Fachkollegen (Responsible Editor); "Aluminium-Taschenbuch"; 14$^{th}$ Edition; Aluminium-Verlag Dusseldorf; 1983; pp. 421-427 and 435.

Jian, Xiaogang; "The Effect of Ultrasonic Vibration on the Solidification of Light Alloys"; Trace: Tennessee Research and Creative Exchange; Doctorial Dissertations; University of Tennessee, Knoxville; URL: http://trace.tennessee.edu/utk_graddiss/2144; Dec. 2005.

German Office Action dated May 11, 2014 issued in German Patent Application No. DE 11 2010 003 405.2. English Translation.

HYPOEUTECTIC

EUTECTIC

HYPEREUTECTIC

As-cast
COMPARATIVE
EXAMPLE

SONO-SOLIDIFIED

QUENCHED FROM 578°C

QUENCHED FROM 577°C

QUENCHED 20 SECONDS AFTER 577°C IS REACHED

COMPARATIVE EXAMPLE

COMPARATIVE EXAMPLE

MATERIAL COMPONENTS

Chemical compositions of Al-Si alloys (mass%)

| | Si | Fe | Cu | Ti | Al |
|---|---|---|---|---|---|
| Al-7Si | 7.01 | 0.042 | 0.007 | 0.003 | bal |
| Al-12Si | 11.98 | 0.040 | 0.001 | 0.002 | bal |
| Al-18Si | 18.01 | 0.039 | 0.001 | 0.001 | bal |
| Al-25Si | 25.4 | 0.27 | 0.02 | — | bal |

Physical properties of aluminum and silicon.

| items | symbol | aluminum | silicon |
|---|---|---|---|
| melting point (°C) | $T_m$ | 660.1 | 1412 |
| volume change during melting (%) | $\Delta V_m$ | 6.5 | −10 |
| latent heat of fusion (kj/mol) | $\Delta H_m$ | 10.47 | 50.66 |
| atomic weight (g/mol) | m | 26.9815 | 28.0855 |
| density of the liquid (kg/m³) | $1/V_{liq}$ | 2385 | 2530 |

MICROCRYSTALLINE ALLOY, METHOD FOR PRODUCTION OF THE SAME, APPARATUS FOR PRODUCTION OF THE SAME, AND METHOD FOR PRODUCTION OF CASTING OF THE SAME

BACKGROUND OF THE INVENTION

1. Field of Invention

The present invention relates to a microcrystalline alloy, a method for the production of the alloy, an apparatus for the production of the alloy, and a method for the production of a casting of the alloy. The present invention is directed, in particular, to an Al—Si alloy.

2. Description of Related Art

It is widely known that when a liquid is irradiated with ultrasonic waves, an acoustic stream or ultrasonic cavitation is generated in the liquid. Many applications of ultrasonic waves to metal liquid-phase processes have also been reported, and, above all, refinement of a solidification structure by ultrasonic waves has been conventionally known. It is also said that a physical phenomenon such as ultrasonic cavitation closely relates to refinement of metal crystal grains, and applying ultrasonic vibration to a casting process has become common knowledge.

For example, Japanese Patent Application Publication No. 7-278692 (JP-A-7-278692) describes a method for the production of a hypereutectic Al alloy die-cast member that has an Si content of 20 to 40%. The production method achieves refinement of coarse acicular primary crystal Si by immersing an ultrasonic vibrator into a melt of a material and applying ultrasonic vibration to the melt through the ultrasonic vibrator to produce a die cast member that has high strength.

Japanese Patent Application Publication No. 2006-102807 (JP-A-2006-102807) describes a method for reforming a metal structure. In this method, ultrasonic vibration is applied to a molten metal in a mold from a horn located a specified distance away from the surface of the molten metal. Then, fine nuclei are formed in the molten metal and dendrites of the primary crystal are destroyed, resulting in a fine solidification structure.

Japanese Patent Application Publication No. 7-90459 (JP-A-7-90459) describes an abrasion-resistant aluminum alloy and a method for the production of the alloy. The machinability and hot workability of the alloy are improved by reducing the Si content to a value that is lower than those of conventional aluminum alloys and adding P instead, and by properly setting the contents of Mn, Ni, Cr, and Zr.

However, only the refinement of the primary crystal Si can be achieved by the technique that is described in JP-A-7-278692, and the refinement of primary crystal α-Al cannot be achieved by the technique. In addition, since the ultrasonic vibrator is immersed into the melt, the ultrasonic vibrator is deteriorated by adhesion of the melt.

Also, with the technique that is described in JP-A-2006-102807, microcrystalline grains cannot be refined while macrocrystalline grains can be refined.

Further, the technique that is described in JP-A-7-90459 is a method for refining the primary crystal Si by applying chemical means such as additives, and it is expected that various components that are added as additives cause various problems such as poor recyclability, increase in workload for preparation and control of the additives, segregation during casting, chipping during machining, and corrosion and diffusion during use. In addition, addition of such additives can achieve the refinement of the primary crystal Si but cannot achieve the refinement of the primary crystal α-Al.

In other words, with the above crystal refinement techniques that employ an ultrasonic vibration method, only the refinement of macrocrystalline grains can be achieved, and it is difficult to achieve the refinement of a microcrystalline structure. Specifically, in order to achieve the refinement of the microcrystalline structure, a technique is required by which the primary crystal α-Al can be crystallized.

SUMMARY OF THE INVENTION

The present invention provides an alloy that has a microcrystalline structure wherein a microcrystalline structure is refined by crystallization of a primary crystal, a method for the production of the alloy, an apparatus for the production of the alloy, and a method for the production of a casting of the alloy.

A first aspect of the present invention is an alloy that has a microcrystalline structure that is obtained by applying a pressure to an alloy melt during a process of cooling the melt and then by crystallizing a fine primary crystal. An Al—Si alloy is an example of the alloy. Meanwhile, the α-Al is an example of the primary crystal.

Since the primary crystal α-Al is crystallized by applying a pressure to an Al—Si alloy melt during a process of cooling the melt to obtain the microcrystalline structure, the crystallization range of Si becomes significantly narrower so that the Si is refined, resulting in an Al—Si alloy that has improved mechanical characteristics.

The pressure may be applied using ultrasonic cavitation that is generated in the melt by applying ultrasonic vibration to the melt.

Since the primary crystal α-Al is crystallized by applying a pressure to the melt using ultrasonic cavitation to obtain the microcrystalline structure, the crystallization range of Si becomes significantly narrower so that the Si is refined, resulting in an Al—Si alloy that has improved mechanical characteristics.

The Al—Si alloy may be hypereutectic.

A second aspect of the present invention is a method for the production of an alloy that has a microcrystalline structure, which includes a melting step in which an alloy is melted to obtain an alloy melt; a pressure applying step in which a pressure is applied to the melt in the cooling process the melt; and a cooling step in which the melt is quenched. As an example of the alloy, there may. be mentioned an Al—Si alloy.

Since primary crystal α-Al is crystallized by applying a pressure to an Al—Si alloy melt during a process of cooling the melt to obtain the microcrystalline structure, the crystallization range of Si becomes significantly narrower so that the Si is refined, resulting in an Al—Si alloy that has improved mechanical characteristics.

The Al—Si alloy may be hypereutectic.

In the pressure applying step, the pressure may be applied using ultrasonic cavitation that is generated in the melt by applying ultrasonic vibration to the melt.

Since the primary crystal α-Al is crystallized by applying a pressure to the melt using ultrasonic cavitation to obtain the microcrystalline structure, the crystallization range of Si becomes significantly narrower so that the Si is refined, resulting in an Al—Si alloy that has improved mechanical characteristics.

A third aspect of the present invention is directed to a production apparatus for the production of an alloy that has a microcrystalline structure wherein a fine primary crystal is crystallized by applying ultrasonic vibration to an alloy melt during a process of cooling the melt. The production apparatus includes: an ultrasonic transducer that generates the ultrasonic vibration; an ultrasonic transmitter that is connected to the ultrasonic transducer and transmits the ultrasonic vibration in a specified direction; a treatment vessel that holds the melt and is in contact with the ultrasonic transmitter; and a treatment vessel fixing device that fixes the treatment vessel by pressing the treatment vessel against the ultrasonic transmitter, in which the ultrasonic vibration is applied to the melt via the treatment vessel. As an example of the alloy, there may be mentioned an Al—Si alloy. As an example of the primary crystal, there may be mentioned α-Al.

Since the apparatus is configured to apply ultrasonic vibration to the melt in a non-contact manner without immersing the ultrasonic transmitter in the melt, contamination of the melt through the ultrasonic transmitter and deterioration of the ultrasonic transmitter by adhesion of melt can be prevented, and the yield and the service life of the apparatus can be improved.

A fourth aspect of the present invention includes: a melting step in which an alloy is melted to obtain an alloy melt; a pressure applying step in which a pressure is applied to the melt during a process of cooling the melt; and a casting step in which casting of the alloy casting is carried out using the melt in which a fine primary crystal has been formed during the cooling process. As an example of the alloy, there may be mentioned an Al—Si alloy. As an example of the primary crystal, there may be mentioned α-Al.

By forging the alloy in which the primary crystal α-Al has been formed, a casting that has a high strength, a high toughness, and an abrasion resistance can be obtained.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein:

FIGS. 2D, 2E and 2F are photographs that show the microstructure in a cross-section of each of sono-solidified samples to which ultrasonic vibration was applied until the completion of eutectic solidification, wherein FIGS. 2A and 2D are photographs of Al-7 mass % Si alloy samples, FIGS. 2B and 2E are photographs of Al-12 mass % Si alloy samples, and FIGS. 2C and 2F are photographs of Al-18 mass % Si alloy samples;

FIG. 3A to FIG. 3C are photographs that show the microstructure of each of Al-18 mass % Si alloys that were formed by quenching (cooling with water) from different temperature conditions, wherein FIG. 3A is a photograph that shows the microstructure that was formed by quenching from 578° C., FIG. 3B is a photograph that shows the microstructure that was formed by quenching 1 s after the eutectic temperature was reached, and FIG. 3C is a photograph that shows the microstructure that was formed by quenching 20 s after the eutectic temperature was reached;

FIGS. 6A and 6B are photographs that show the microstructure of each of Al-18 mass % Si alloys at the bottom of samples that were formed by quenching (cooling with water) from different temperature conditions under ultrasonic vibration, wherein FIG. 6A is a photograph that shows the microstructure that was quenched from 582° C., and FIG. 6B is a photograph that shows the microstructure that was quenched from 578° C.;

FIGS. 8A and 8B are views that show the intensity profile of Si—Kα in a cross-section of each α-Al phase, wherein FIG. 8A shows an intensity profile of an Al-7 mass % Si alloy that was solidified without application of ultrasonic vibration, and FIG. 8B shows an intensity profile of an Al-18 mass % Si alloy that was solidified under ultrasonic vibration;

DETAILED DESCRIPTION OF EMBODIMENTS

Figure 1:
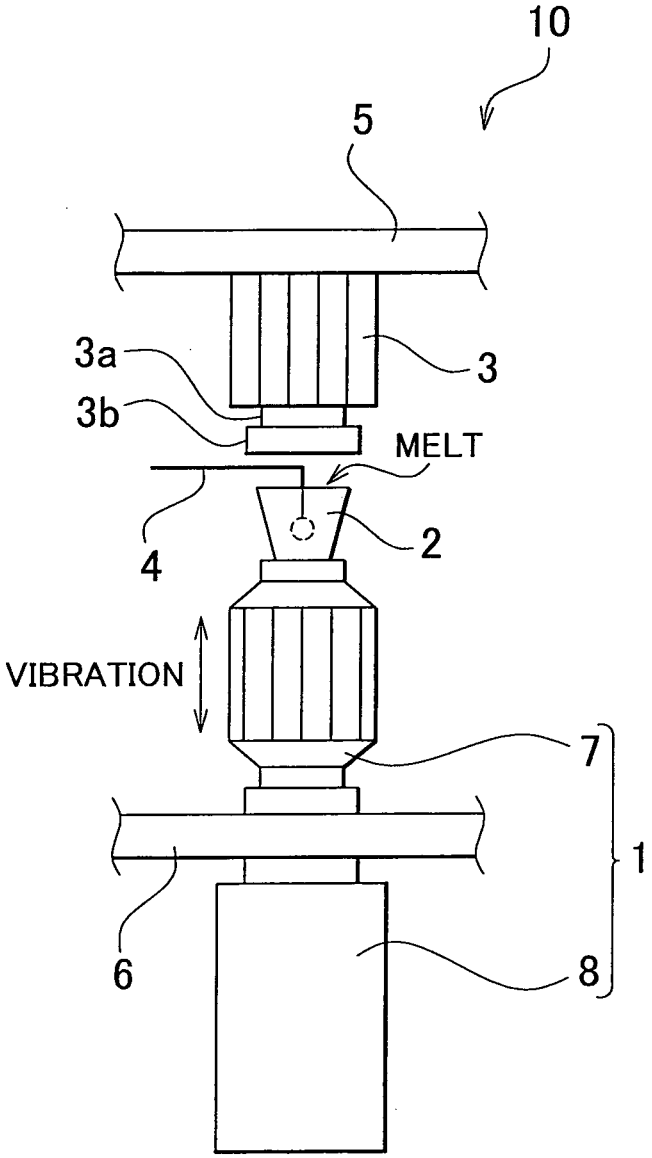
FIG. 1 is a side view that illustrates an overall configuration of an experimental apparatus (ultrasonic vibration apparatus) that applies ultrasonic vibration to an Al—Si alloy melt to solidify it according to one embodiment of the present invention.

An experimental apparatus to which a method for the production of a microcrystalline Al—Si alloy according to an embodiment of the present invention is applied is described with reference to FIG. 1. It should be noted that while an embodiment of the present invention is described with reference to an apparatus that experimentally produces a microcrystalline Al—Si alloy in this embodiment, the present invention is not specifically limited to the configuration of this apparatus and the same effects as those of the present invention can be achieved when a casting device or the like is constituted to have the configuration similar to the experimental apparatus according to this embodiment.

An experimental apparatus 10 (which is hereinafter referred to as "apparatus 10") is an apparatus that is configured to solidify a metal melt in a cooling process while applying ultrasonic vibration thereto. As shown in FIG. 1, the apparatus 10 is equipped with an ultrasonic generator 1, a treatment vessel 2, a treatment vessel fixing device 3, a thermocouple 4, upper and lower plates 5 and 6, and a melt water-cooling device and a timer (which are not shown). A process of solidifying a metal melt in the cooling process while applying ultrasonic vibration thereto is hereinafter referred to as "sono-solidification".

The ultrasonic generator 1 includes an ultrasonic horn 7 as an ultrasonic transmitter, and an ultrasonic transducer 8 that is coupled to a lower part of the ultrasonic horn 7.

The ultrasonic horn 7 is a resonator that is made of a metal (made of Ti-6 Al-4V (mass %) alloy) and is adapted to transmit vibration energy, which is generated by the ultrasonic transducer 8 in a specified direction (in a direction of the arrow shown in FIG. 1 in this embodiment), to an object to which the vibration energy is to be transmitted. The ultrasonic horn 7 has an upper end surface on which the bottom of the treatment vessel 2 as the object to which the vibration energy is to be transmitted can be placed in contact therewith, and an outer peripheral surface that is formed in the shape of fins to improve air-cooling efficiency of the horn itself. The ultrasonic transducer 8 is connected to a high-frequency power source via an ultrasonic oscillator (which is not shown) and is capable of generating ultrasonic vibration with specific vibration conditions.

The treatment vessel 2 is a cup-shaped crucible that is made of a metal (a vessel that is made of SUS304 and has an upper inside diameter of 40 mm, an inside bottom diameter of 30 mm, and an effective depth of 33 mm), and can hold a specified amount of a melt (Al—Si alloy melt in this embodiment). The expression "a specified amount of a melt," in this case, means that the treatment vessel 2 contains the melt but is not full to the brim so that there is a specific distance between the melt surface and the upper end surface of the treatment vessel 2 when ultrasonic vibration is applied to the melt.

The treatment vessel fixing device 3 is an air cylinder that has a rod 3*a* which can extend and contract vertically, and a buffer 3*b* at an end of the rod 3*a* that holds the upper end of the treatment vessel 2 when the rod 3*a* extends downward (toward the treatment vessel 2). The treatment vessel fixing device 3 can fixedly hold the treatment vessel 2 by extending the rod 3*a* of the air cylinder downward until the lower side of the buffer 3*b* abuts against the upper end of the treatment vessel 2 and pressing the upper end of the treatment vessel 2 toward the ultrasonic horn 7 at a specified pressure.

The thermocouple 4 is a melt temperature meter, and can be immersed into the melt that is held in the treatment vessel 2 to measure the melt temperature at a specified position in the melt. The thermocouple 4 is connected to a measuring and recording device (which is not shown), and the measuring and recording device can monitor and record the measured melt temperature continuously. The crystalline state that is formed during a process of cooling the melt can be known based on the melt temperature that is measured by the thermocouple 4, and, as a result, a material that has a desired crystalline structure can be obtained.

The upper plate 5 fixedly supports the air cylinder as the treatment vessel fixing device 3. The lower plate 6 fixedly supports the ultrasonic horn 7 and the ultrasonic transducer 8. In addition, the upper and lower plates 5 and 6 are disposed with a specified distance maintained therebetween, and are placed such that the lower plate 6 is located at a resonant antinode of the ultrasonic transducer 8 when ultrasonic vibration is being applied.

The melt water-cooling device can quench the melt under specified conditions (temperature and time), and can solidify the melt into any desired crystalline structure by properly adjusting the conditions.

The timer measures the time that is taken to reach a cooling step in which the melt is quenched. The timer is used in time management to improve the reliability of the crystalline structure formation (reproducibility of the crystalline structure).

By constructing the apparatus 10 as described above, when the air cylinder is driven to cause the buffer 3*b* to fixedly hold the upper end of the treatment vessel 2 and the ultrasonic transducer 8 is vibrated under specified vibration conditions by the ultrasonic oscillator (which is not shown) after the treatment vessel 2 into which a specified amount of melt has been poured is placed on the upper end of the ultrasonic horn 7, ultrasonic vibration can be applied to the melt in a non-contact manner (in a state where the melt and the ultrasonic horn 7 are not in direct contact with each other) and ultrasonic cavitation (bubbles) and an acoustic stream can be generated in the melt in the treatment vessel 2. That is, the apparatus 10 can transmit ultrasonic vibration to the melt in the treatment vessel 2 by applying ultrasonic vibration to the bottom surface of the treatment vessel 2 that is pressed against the upper end surface of the ultrasonic horn 7. The apparatus 10 can therefore apply ultrasonic vibration to the melt in a non-contact manner. In other words, since the apparatus 10 applies ultrasonic vibration to the melt in a non-contact manner without directly immersing the ultrasonic horn 7 into the melt, contamination of the melt through the ultrasonic horn 7 and deterioration of the ultrasonic horn 7 by adhesion of melt can be prevented and the yield and the service life of the apparatus can be improved. In addition, the apparatus 10 is also a pressure applying apparatus that applies a specified pressure to the melt by using the ultrasonic cavitation, and can apply a localized pressure in the melt with high efficiency. It should be noted that, while the apparatus 10 uses ultrasonic cavitation that is induced by ultrasonic vibration as a pressure applying apparatus in this embodiment, the present invention is not particularly limited thereto and may employ a system in which the entire melt is integrally pressurized by a specified pressure device, for example. Experiments that were conducted, to obtain a microcrystalline Al—Si alloy using the above-described apparatus 10 as examples of the present invention are described below in detail.

EXAMPLES

Experimental Method:

The outline of the apparatus 10, which was used to apply ultrasonic vibration to the metal melt in this example, is shown in FIG. 1. When ultrasonic vibration was applied to the melt in the treatment vessel (crucible) 2, the bottom surface of the treatment vessel 2 was pressed against the end face of the ultrasonic horn 7 using the buffer 3*b* and the air cylinder. By applying ultrasonic vibration to the bottom surface of the treatment vessel 2, which was in pressure contact with the end face of the ultrasonic horn 7, the ultrasonic vibration was transmitted to the melt in the treatment vessel 2. The ultrasonic vibration applying conditions were an output of 2,000 W, a total amplitude of 20 μm, and a resonance frequency of 20 kHz. The total amplitude of 20 μm was a measurement that was obtained when no load was exerted on the end of the horn. As sample alloys, in addition to a hypereutectic Al-18 mass % Si alloy, a hypoeutectic Al-7 mass % Si alloy, an almost eutectic Al-12 mass % Si, and hypereutectic Al-25 mass % Si alloys were used (the notation "mass %" is hereinafter omitted). The chemical compositions of these commercially available alloy ingots are summarized in FIG. 10.

The hypereutectic Al-18 Si alloy and the Al-25 Si were melted at 730° C. and 830° C., respectively, and teemed at 690° C. and 760° C., respectively. The hypoeutectic Al-7 Si alloy and the almost eutectic Al-12 Si alloy were melted at 730° C. and teemed at 640° C. No grain refiner was added to any of the Al—Si alloy melts, and Ar was blown from an end of an $Al_2O_3$ pipe for 0.9 ks as a degassing operation. In every case, approximately 65 g of the melt was teemed into the treatment vessel 2, and ultrasonic vibration started to be applied immediately after the teeming. When the melt reached a specified temperature, the melt, together with the treatment vessel 2, was quenched into water to preserve the microstructure. A type K thermocouple was used to continuously measure and record the temperature of the melt in the cooling process. The temperature measurement and structure observation were made at a point almost in the center of the sample, which is on the center line of the vessel and 8 mm away from the bottom of the vessel unless otherwise noted. Temperature measurement and structure observation were also made at a lower point (3 mm away from the bottom surface) and a higher point (13 mm) in some of the sono-solidification experiments.

To verify only the influence of the acoustic stream that was induced in the melt by ultrasonic vibration, a vortex flow was created in the melt by mechanical stirring and crystallization of α-Al during the process of solidification of the hypereutectic Al—Si alloy was observed. In the mechanical stirring experiments for the purpose, an vessel that is made of SUS304, the same vessel as the above mentioned one that was used for the sono-solidification was used, and a two-propeller stirrer (which is not shown) was rotated at 23 $s^{-1}$ (1400 rpm) to create a stirring flow. Then, after mechanically stirring the melt until the melt underwent partial eutectic solidification, the melt, together with the vessel, was cooled with water. A line analysis with Electron Probe Micro Analyzer (EPMA) was conducted to compare the Si contents in a primary crystal α-Al phase that appears in a normally solidified hypoeutectic Al—Si alloy and in a nonequilibrium α-Al phase that is crystallized in the hypereutectic Al—Si alloy by sono-solidification. In preparing samples, the melts were quenched into water immediately after the completion of eutectic solidification to avoid a change in the Si concentration during the cooling process, and EPMA analysis was performed on the cross-sections of the samples. The microhardness (Vickers hardness) of the α-Al phases that were crystallized in the hypoeutectic and hypereutectic Al—Si alloys were also measured. The samples for hardness measurement were not quenched but air-cooled to room temperature, however.

The results and considerations of the experiments are described below.

Change in Microstructure by Sono-Solidification

Figure 2A:
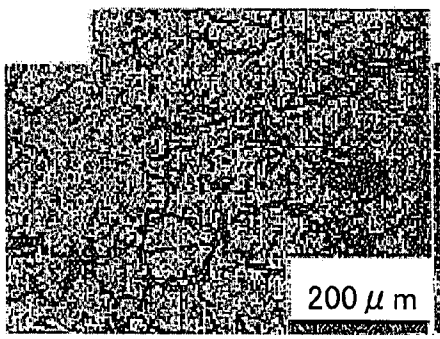
FIGS. 2A, 2B and 2C are photographs that show the microstructure in a cross-section of each of samples that were solidified without application of ultrasonic vibration.
Figure 2B:
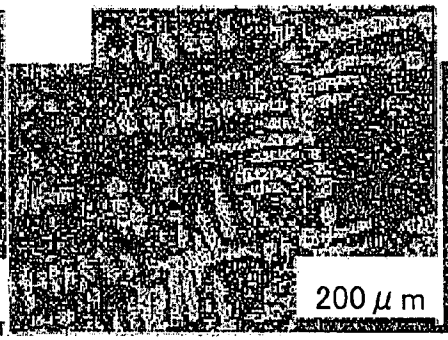
Figure 2C:
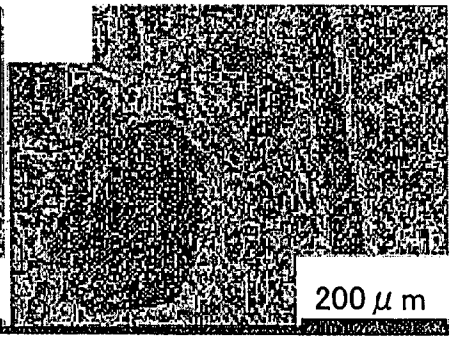
Figure 2D:
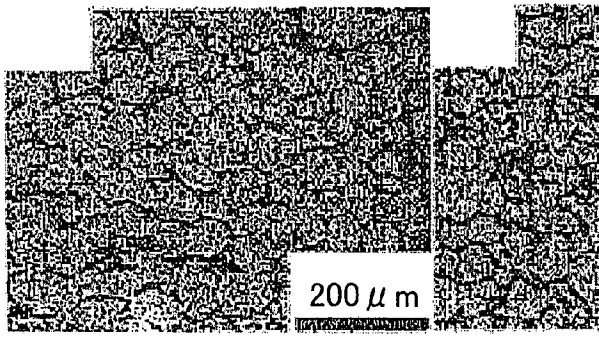
Figure 2E:
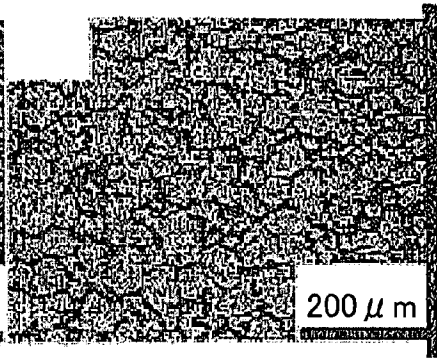
Figure 2F:
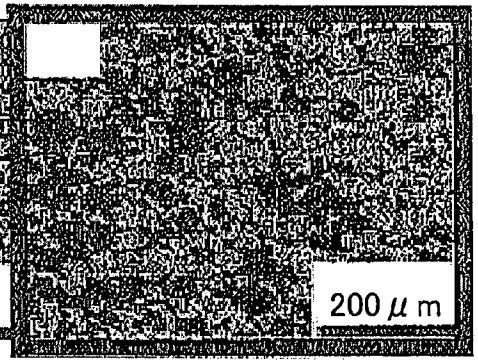

Differences in solidification structure among the hypoeutectic Al-7 Si, eutectic Al-12 Si, and hypereutectic Al-18 Si alloys that depend on whether or not ultrasonic vibration was applied are shown in FIG. 2A to FIG. 2F. The upper column shows the microstructures in a cross-section of the sono-solidified samples to which ultrasonic vibration was not applied, and the lower column shows the microstructures in a cross-section of the sono-solidified samples to which ultrasonic vibration was applied until the completion of eutectic solidification. In each of the microstructures that are shown in FIG. 2A to FIG, 2F, white regions are α-Al phase regions, and gray regions are Si phase regions. In the hypoeutectic composition in FIG. 2A that was solidified without application of ultrasonic vibration, a dendritic primary crystal α-Al phase has grown, and relatively large eutectic Si grains are found between the dendrite arms. In the eutectic composition that is shown in FIG. 2B, dendrite of the primary crystal α-Al phase has grown because the chemical composition of the sample was slightly hypoeutectic and because the cooling rate was high. In the case of the hypereutectic composition that is shown in FIG. 2C, α-Al regions are found around primary crystal Si grains that have grown to large sizes, and eutectic Si has grown to relatively large sizes. On the contrary, in the sono-solidified hypoeutectic Al-7 Si alloy structure that is shown in FIG. 2D, the primary crystal α-Al phase, which was dendritic, has become granular (generally spherical). In each of the eutectic Al-12 Si that is shown in FIG. 2E and the hypereutectic Al-18 Si that is shown in FIG. 2F, crystallization of a large number of granular α-Al phase regions that look white is particularly notable (the average grain diameter of α-Al is 54 μm, the number of grains of α-Al per 0.08 $mm^2$ is 33 to 55, and the average grain diameter of Si is 10 μm in FIG. 2E; the average grain diameter of α-Al is 54 μm, the number of grains of α-Al per 0.08 $mm^2$ is 33 to 55, and the average grain diameter of Si is 20 to 50 μm (average grain diameter is 35 μm) in FIG. 2F). As a result, eutectic structure regions were significantly decreased. In the case of the Al-12 Si, slight crystallization of massive Si, which is different from eutectic Si, is also found. In the case of the hypereutectic composition, the primary crystal Si, which was coarse when ultrasonic vibration was not applied, was pronouncedly refined by sono-solidification. In the case of sono-solidification, the eutectic Si, which was in a plate shape, was transformed into fine grains irrespective of the Si content. Conclusions that can be drawn from the above are as follows. When the hypoeutectic Al-7 Si is sono-solidified, the primary crystal α-Al phase is transformed from the dendritic to granular form, and the eutectic structure regions is decreased. In the eutectic composition, massive Si grains, which are different in form from eutectic Si grains, appear along with crystallization of granular α-Al phase that is excessive as compared with that in an equilibrium state. In the hypereutectic composition, crystallization of the distinctive nonequilibrium α-Al phase is observed in addition to refinement of primary crystal Si grains. It is believed that not only the primary crystal is refined but also the eutectic solidification is influenced by sono-solidification. The process of crystallization of the nonequilibrium α-Al phase by sono-solidification is described below using primarily a hypereutectic Al-18 Si alloy.

Crystallization of Nonequilibrium Granular α-Al Phase

Figure 3A:
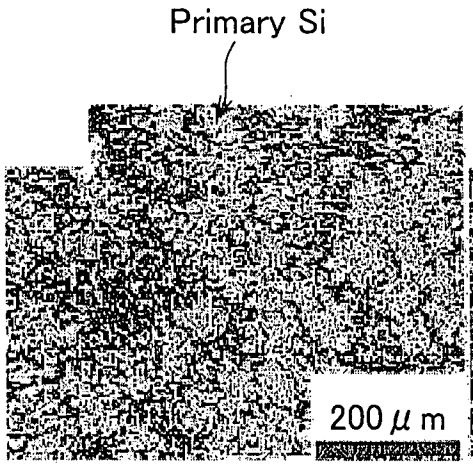
Figure 3B:
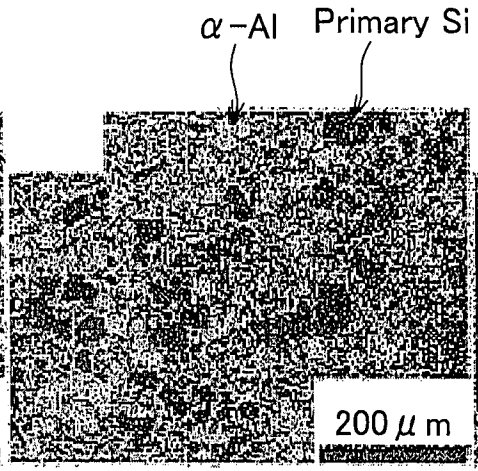
Figure 3C:
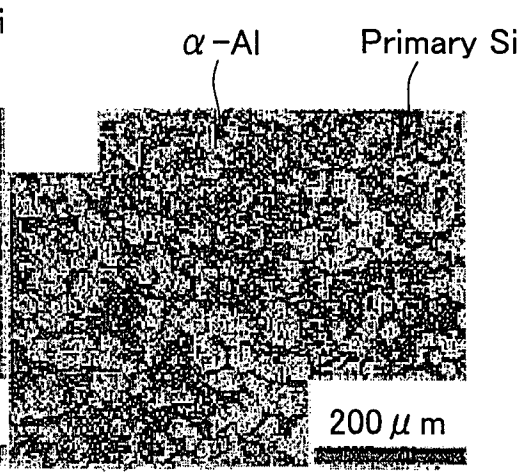
Figure 4:
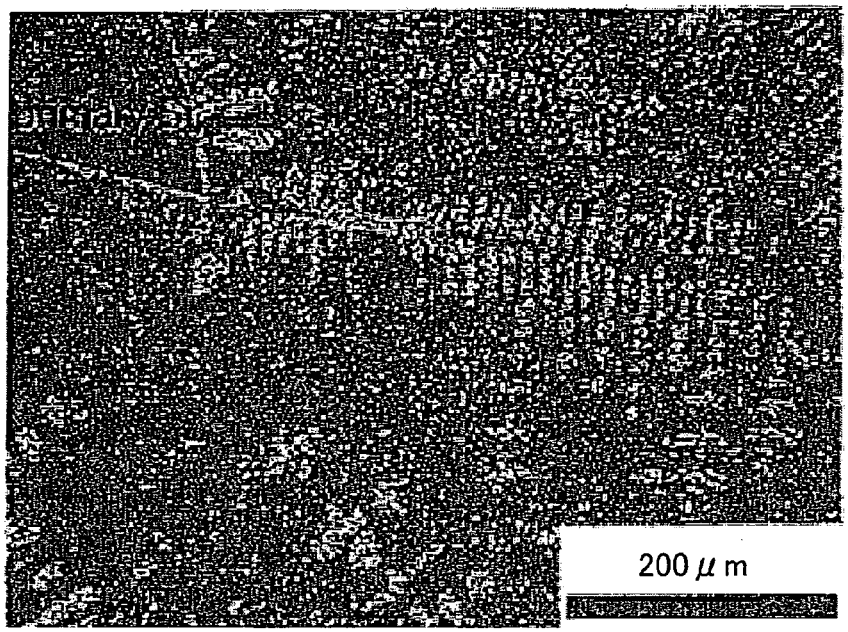
FIG. 4 is a photograph that shows the microstructure of an Al-18 mass % Si alloy that was formed by quenching (cooling with water) from 578° C. without application of ultrasonic vibration.
Figures 11, 12:
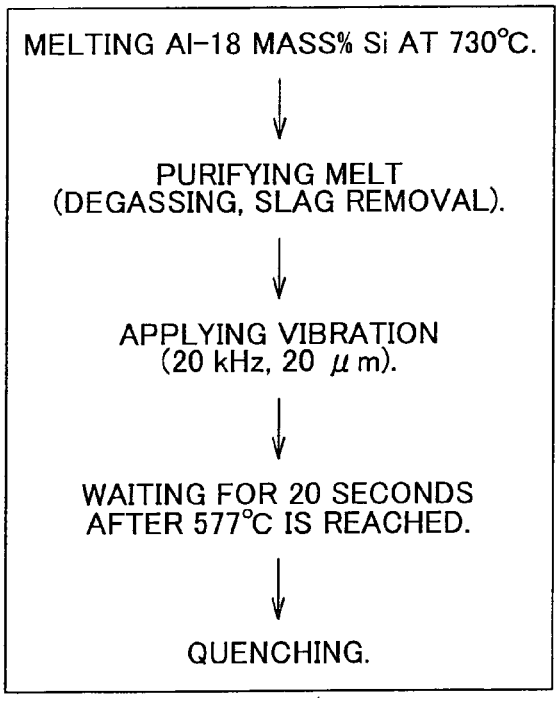
FIG. 11 is a view that shows physical properties of Al and Si.
FIG. 12 is a view that illustrates a production flow of an Al-18 mass % Si alloy that has a microstructure that is shown in FIG. 3C.

Since the nonequilibrium α-Al phase, which is not crystallized in hypereutectic Al-18 Si alloys under normal circumstances, was formed by sono-solidification, an experiment to identify the exact time of crystallization of the nonequilibrium α-Al phase was first conducted. Sample melts that had been solidified to different solid phase rates under ultrasonic vibration were quenched into water. As a representative example, the microstructures in the central part of sono-solidified and quenched samples (8 mm away from the bottom surface) are shown in the order of the progress of solidification in FIG. 3A to FIG. 3C. In the case of FIG. 3A, which shows the microstructure of a sample that was quenched from a temperature immediately above the eutectic temperature, α-Al phase regions that have grown from the interfaces between the primary crystal Si grains are found in addition to refined primary crystal Si grains. For comparison, a hypereutectic Al-18 Si alloy melt without ultrasonic wave treatment was quenched from a temperature immediately above the eutectic temperature (578° C.). The microstructure in the central part thereof is shown in FIG. 4. The α-Al phase regions are found at the interfaces between the primary crystal Si grains, and some of them have grown to a dendritic form. It is believed that a liquid phase was present around the primary crystal Si at the temperature immediately above the eutectic temperature before quenching. It is, therefore, not clear from FIG. 3A, which shows the microstructure of a sono-solidified sample, whether or not crystallization of the nonequilibrium α-Al phase took place at the temperature immediately above the eutectic temperature. FIG. 3B shows a structure that was quenched is after the eutectic temperature was reached, and FIG. 3C shows a structure that was quenched 20 s after the eutectic temperature was reached (see the flow that is shown in FIG. 12). It should be noted that, in the case of the sono-solidification in this example, time for the eutectic solidification of the Al-18 Si alloy melt was approximately 45 s. In FIG. 3B, not only refined primary crystal Si grains but also the granular α-Al phase are clearly found, and it is therefore believed that nonequilibrium α-Al grains were present since before quenching. In FIG. 3C, the numbers of granular α-Al phase regions and Si grains are further increased. When the hypereutectic Al-18 Si alloy melt is sono-solidified, crystallization of nonequilibrium α-Al grains occurs in the central part of the sample immediately after the eutectic temperature is reached, and its number increases rapidly with the progress of eutectic solidification.

Crystallization of Granular α-Al Phase by Mechanical Stirring

Figure 5:
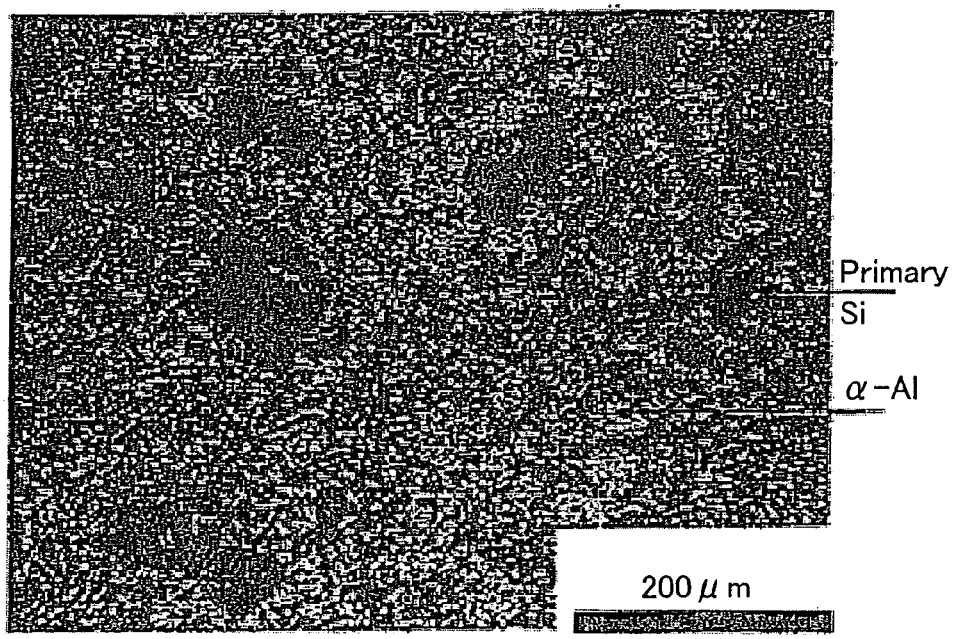
FIG. 5 is a photograph that shows the eutectic crystal of an Al-18 mass % Si alloy that is obtained by mechanical stirring without application of ultrasonic vibration.

The number of nonequilibrium α-Al grains, which are not crystallized in hypereutectic Al—Si alloys under normal circumstances, increases with the progress of eutectic solidification. However, it was not clear from the observation of the structure in the central part of the sono-solidified sample whether the crystallization of nonequilibrium α-Al phase started before the eutectic temperature was reached. As a similar solidification phenomenon, a separated eutectic structure, which is formed when an almost eutectic Al—Si alloy melt is solidified under mechanical stirring and in which massive Si grains are present independently from the α-Al phase, has been reported. The explanation is that the α-Al phase and Si grains are separately present because eutectic Si is forcibly peeled off from the solidification interface where Si/α-Al coexist by a stirring flow during the process of eutectic solidification. Thus, to clarify the stirring effect of an acoustic stream, an experiment using mechanical stirring, which is considered to generate less ultrasonic cavitation, was conducted. Using the same experimental apparatus as shown in FIG. 1, an Al-18 Si alloy melt is solidified up to an intermediate stage of eutectic crystallization under mechanical stirring by a propeller and without application of ultrasonic vibration. A resulting representative microstructure is shown in FIG. 5. Crystallized α-Al grains, in addition to refined primary crystal Si and eutectic regions where Si/α-Al coexist, are found to be formed by the mechanical stirring. It is possible to crystallize the Si phase and α-Al phase in a partially separated state by applying mechanical stirring during the process of eutectic solidification of the Al-18 Si alloy. When sono-solidification is substituted for the solidification using mechanical stirring, the α-Al phase may be separately crystallized during the process of eutectic solidification of the hypereutectic Al—Si alloy, that is, at the eutectic temperature (577° C.), by the effect of the acoustic stream.

Figure 6A:
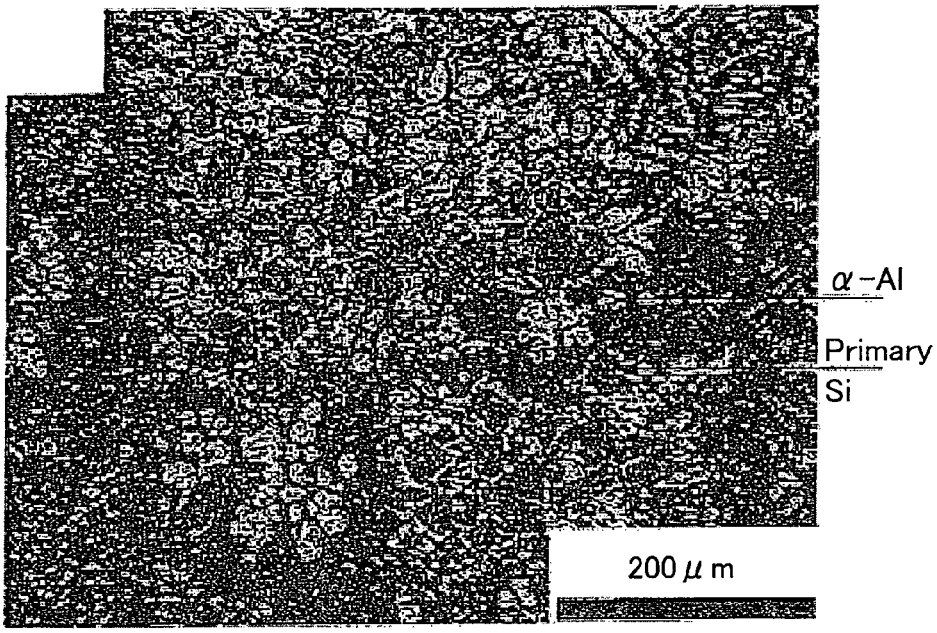
Figure 6B:
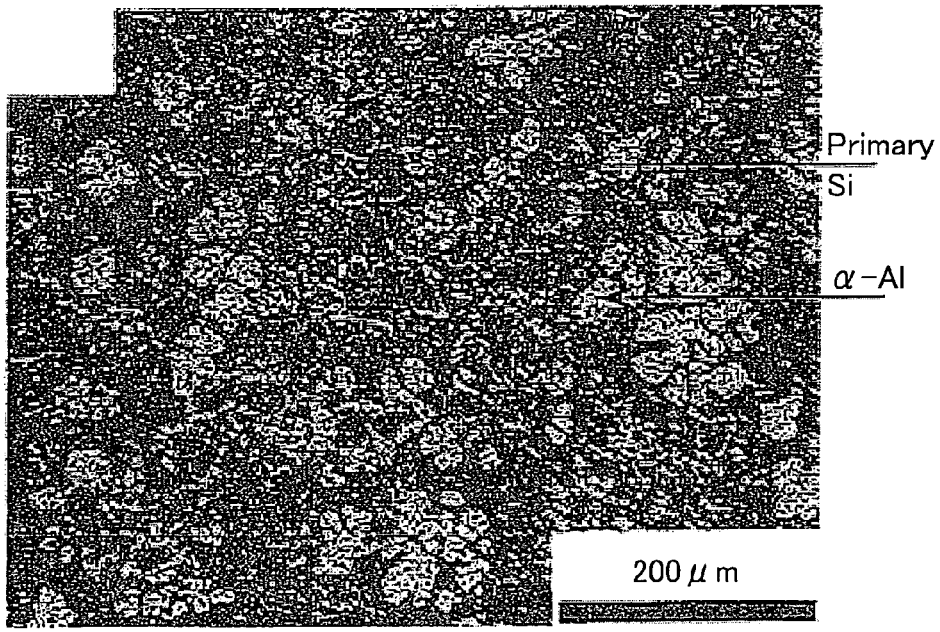

Crystallization of Granular α-Al Phase at Temperature Equal to or Higher than Eutectic Temperature In the microstructure at the bottom of the sample that was quenched from a temperature immediately above the eutectic temperature during the process of sono-solidification, crystallization of nonequilibrium α-Al grains was clearly found to have occurred in contrast to the microstructure in the central part thereof, which is shown in FIG. 3A. For example, microstructures at the bottom of sono-solidification samples that were quenched from 582° C. and 578° C., respectively, which are higher than the eutectic temperature, are shown in FIG. 6A and FIG. 6B. Crystallization of refined primary crystal Si grains and the granular α-Al phase, in addition to a fine dendritic α-Al phase that is believed to have crystallized from the melt during the cooling process, is found to have occurred not only in the structure in FIG. 6B that was quenched from 578° C. but also in the structure in FIG. 6A that was quenched from 582° C., which is 5° C. higher than the eutectic temperature. It is believed that the granular α-Al phase grains at the bottom of the sample were already present in the liquid phase immediately before the quenching because it has a grain size of about 30 μm.

The melt temperatures at points which were on the sample center line and 3 mm, 8 mm and 13 mm away from the bottom were continuously recorded during the process of sono-solidification. When ultrasonic vibration was not applied, the temperatures at the upper, lower and intermediate points reached the eutectic temperature. There was a difference between a time at which the temperature at the upper point reached the eutectic temperature and a time at which the temperature at the intermediate point reached the eutectic temperature, and the time difference was about 5 s. However, on the cooling curve during the process of sono-solidification, there was almost no difference in the time at which the eutectic temperature was reached between the upper, intermediate and lower points because of the stirring effect of the acoustic stream. It is, therefore, believed that, in sono-solidification, not only primary crystal Si grains but also the granular α-Al phase had been crystallized in the pre-eutectic liquid phase at the bottom of the vessel before the eutectic temperature was reached because there was no difference in the time at which the eutectic temperature was reached between the points. It can be seen from a comparison between FIG. 6A and FIG. 6B that the nonequilibrium α-Al phase grew to a granular form and its number increased with the progress of cooling. Even in sono-solidification, however, there was a difference in the time that was taken for the completion of the eutectic solidification between the upper, intermediate and lower points. It is believed that the completion of eutectic solidification in the central part delays because the melt becomes more difficult to be stirred as the eutectic solidification progresses and thus as the solid phase rate increases. As described above, the nonequilibrium α-Al phase was crystallized in the area near the bottom surface of the sample before the eutectic temperature was reached. This experiment result cannot be explained by the separated eutectic solidification that is induced by an acoustic stream at the eutectic temperature.

Role of Cavitation in Sono-Solidification

Figure 7:
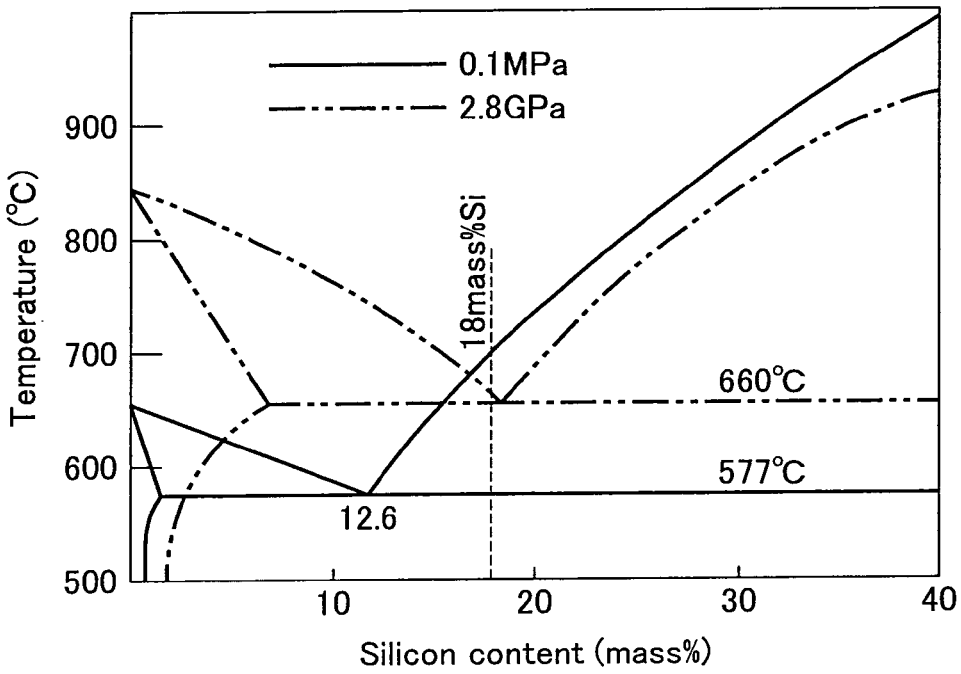
FIG. 7 shows Al—Si system equilibrium diagrams at normal and elevated pressures.

To investigate the effect of ultrasonic cavitation, a vibration experiment was conducted in which vibration was applied to a transparent glass vessel (wall thickness: 1 mm, not shown) with an inside diameter of 25 mm and a depth of 50 mm which was filled with pure water using the ultrasonic vibration system (the apparatus 10) that is shown in FIG. 1. As a result, ultrasonic cavitation bubbles were vigorously generated on and around the bottom surface of the glass vessel, which was in contact with the vibrating end surface. It is believed that cavitation occurs intensely on the bottom surface of the vessel, which is close to the vibrating end and provides effective nucleus generating sites. It is known that the interfaces of cavitation bubbles can be solidification nucleus generating sites and that a high pressure of 1 GPa or higher is generated when cavitation bubbles collapse. Here, a change in the melting point (dT/dP) with increase in pressure can be estimated using Clausius-Clapeyron equation (1).

$$dT/dP=T_m(V_{liq}-V_{sol})/\Delta H_m \quad (1)$$

where $T_m$ represents the melting point, $V_{liq}$ and $V_{sol}$ represent the molar volumes of liquid and solid, respectively $[(V_{liq}-V_{sol})/V_{sol}=\Delta V_m]$, and $\Delta H_m$ represents the molar latent heat of fusion. Physical properties of Al and Si are summarized in the table of FIG. 11. Since solid Al has a higher density than liquid Al and the opposite is true for Si, the pressure dependency of the melting point is calculated as 62° C./GPa for Al and −41° C./GPa for Si. That is, since an Al melt has an elevated melting point at high pressure, it exists in a liquid form at normal pressure but in a solid form at high pressure. Al—Si system equilibrium diagrams at high pressure have been reported, and one example thereof is shown in FIG. 7. Since it is believed that a local high-pressure field with a pressure of 1 GPa or higher is generated in the melt in a region close to the bottom surface of the vessel where cavitation bubbles are concentrated, an equilibrium diagram at a high pressure of 2.8 GPa is shown over an equilibrium diagram at normal pressure in FIG. 7. It can be seen that the liquidus temperature of the α-Al solid solution increases and that the Si content at the eutectic point also increases at a high pressure of 2.8 GPa. At normal pressure, the Si content in the melt approaches 12.6 mass % from 18 mass % with a decrease in temperature in the temperature range in which primary crystal Si is crystallized from the Al-18 Si alloy melt. It is believed that, even in the case of the sono-solidification in this example, α-Al grains as a nonequilibrium phase can be crystallized even at a temperature equal to or higher than the eutectic temperature (577° C.) since a local high-pressure field is generated in a lower region of the sample. There is a possibility that the nonequilibrium α-Al grains that have been crystallized near the bottom surface of the treatment vessel 2 are transported to the center of the sample by the acoustic stream and disappear before the eutectic temperature is reached. This may explain α-Al grains were not clearly observed in the central part (FIG. 3A) of the sample that was quenched from a pre-eutectic temperature. However, when the temperature decreases to the eutectic temperature, the crystallized nonequilibrium α-Al grains are not remelted and can exist.

That is, in the region where ultrasonic cavitation bubbles are concentrated, a local high-pressure field with a pressure of 1 GPa or higher is generated in the melt and, as a result, refinement of the microstructure can be controlled by displacement of the eutectic point.

Si Content and Hardness Characteristics of Nonequilibrium α-Al Phase

Figure 8A:
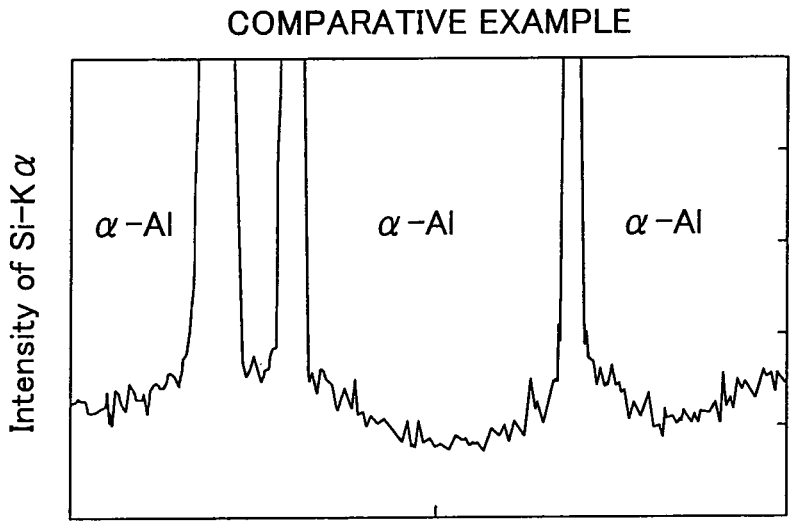
Figure 8B:
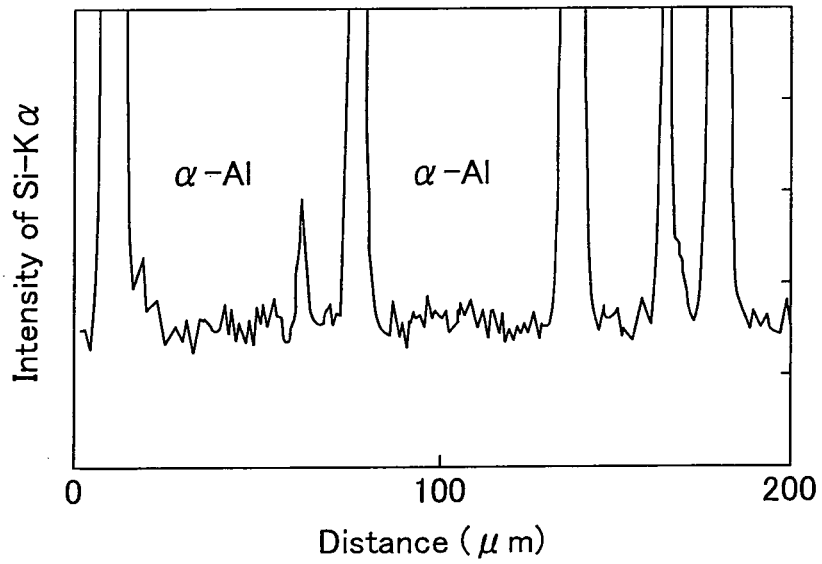
Figures 9, 10:
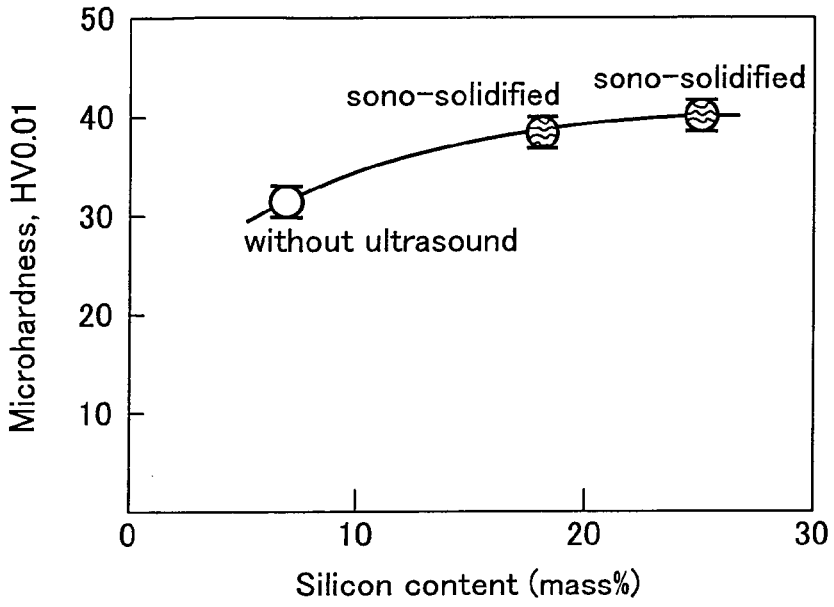
FIG. 9 is a view that illustrates variations in microhardness (Vickers hardness) of α-Al grains that depend on the Si content.
FIG. 10 is a view that shows chemical compositions of Al—Si alloys (mass %)

It is expected from the equilibrium diagram at high pressure in FIG. 7 that when a hypereutectic Al-18 Si alloy is solidified at high pressure, the solute Si content in the nonequilibrium α-Al phase becomes higher than the value at normal pressure. That is, it is believed that the local high-pressure field that is created by ultrasonic cavitation crystallizes the nonequilibrium α-Al phase and increases the Si content in the α-Al phase. To verify the cavitation effect, the Si content in the α-Al phase in a sono-solidified Al-18 Si alloy was measured by EPMA line analysis. For comparison, the Si content in a primary crystal α-Al phase of an Al-7 Si alloy which had been solidified without application of ultrasonic vibration was measured under the same conditions. The results are summarized in FIG. 8A and FIG. 8B. In the case of the Al-7 Si alloy that is shown in FIG. 8A, the Si content in the primary crystal α-Al phase is the lowest in the central part. It can be understood from the equilibrium diagram at normal pressure that is shown in FIG. 7 that when the primary crystal α-Al phase grows, α-Al with a high Si content which is crystallized at a low temperature surrounds the α-Al that has been crystallized at a high temperature. In the α-Al phase that has been crystallized in the sono-solidified Al-18 Si alloy that is shown in FIG. 8B, the Si content in the central part is higher than the corresponding value in the primary crystal α-Al phase that is shown in FIG. 8A. As in the equilibrium diagram at 2.8 GPa that is shown in FIG. 7, the solidus of the α-Al phase moves rightward at high pressure, and the Si solubility limit in the α-Al phase increases. It is believed that the nonequilibrium α-Al phase that was crystallized during the process of sono-solidification in this example was crystallized in the local high-pressure field that was generated when the ultrasonic cavitation bubbles collapse, and it is therefore believed that a high Si content as seen in the equilibrium diagram at high pressure was obtained. It is, however, believed that the high Si content regions were limited in crystal nuclei near the center and that the Si content became almost uniform with the growth of the α-Al phase. Since the nonequilibrium α-Al phase, which is peculiar to sono-solidification, has a higher Si content than primary crystal α-Al that is crystallized with a hypoeutectic composition, improvement in mechanical properties can be expected. The Vickers hardnesses of the nonequilibrium α-Al phase that appeared in the sono-solidified hypereutectic Al—Si alloy and the primary crystal α-Al phase of a normal Al-7 Si alloy were measured. The results are shown in FIG. 9. The α-Al grains that were crystallized as a nonequilibrium phase in the hypereutectic Al—Si alloy is harder than the primary crystal α-Al phase in the hypoeutectic composition. That is, the sono-solidified hypereutectic Al—Si alloy has toughness that is derived from the nonequilibrium α-Al phase, and is expected to have many applications as a novel abrasion-resistant material that contains fine primary crystal Si grains.

As described above, a sono-solidification experiment was conducted in which sample melts were solidified under ultrasonic vibration using, primarily, a hypereutectic Al-18 mass % Si alloy, and the following conclusions were obtained. (1) When a hypereutectic Al—Si alloy is sono-solidified, not only the primary crystal Si is refined but also a large number of grains of a nonequilibrium α-Al phase are crystallized. Because of the crystallization of the granular α-Al phase, the eutectic regions that include Si/α-Al are significantly reduced. (2) Intense generation of cavitation was observed in the vicinity of the bottom surface of the vessel in which the alloy was sono-solidified. A local high-pressure field that is generated by the collapse of cavitation bubbles increases the liquidus temperature of the α-Al phase and raises the Si solubility limit in the α-Al phase. The generation of the local high-pressure field allows crystallization of the nonequilibrium α-Al phase even at a temperature equal to or higher than the eutectic temperature (577° C.). (3) As can be expected from the equilibrium diagram at high pressure, the Si content in the nonequilibrium α-Al phase that has been crystallized by sono-solidification is higher than that in the primary crystal α-Al phase of a normally solidified hypoeutectic Al—Si alloy. As described above, in the case of sono-solidification of a hypereutectic Al—Si alloy, since a nonequilibrium α-Al phase with a high Si content is crystallized at a temperature equal to or higher than the eutectic temperature, it is believed that the local high-pressure field that is generated by the collapse of ultrasonic cavitation bubbles plays a dominant role in the formation of the α-Al phase.

Based on the above experimental results, it is possible to form a microcrystalline structure in which granular α-Al has been crystallized and eutectic regions that include Si/α-Al have been significantly reduced (FIG. 3B and FIG. 3C) by melting an Al-18 Si alloy, which is a hypereutectic Al—Si alloy (Si: 12% or more), applying a local pressure to the melt under specific vibration conditions (frequency: 20 kHz, total amplitude: 20 μm) during the cooling process to solidify the melt using the apparatus 10, which has been described before, to induce sono-solidification of the melt, and quenching the melt at a temperature equal to or higher than the eutectic temperature. In addition, as described above, the nonequilibrium α-Al phase, which is peculiar to sono-solidification, has a higher Si content than the primary crystal α-Al phase of a normally solidified hypoeutectic Al—Si alloy. Moreover, since the hypereutectic Al—Si alloy has a higher Si content, in other words, contains a larger amount of Si component that can improve the abrasion resistance, than primary crystal α-Al that is crystallized with a hypoeutectic composition, it is possible to improve the mechanical characteristics of the resulting solidified Al—Si alloy by controlling the process of crystallization and to cast the alloy with its abrasion resistance and toughness controlled.

As in the description of the above experiment, the method for the production of a microcrystalline Al—Si alloy according to this embodiment includes a melting step in which an Al—Si alloy is melted to obtain an Al—Si alloy melt, a pressure applying step in which a pressure is applied to the melt during a process of cooling, the melt, and a cooling step in which the melt is quenched. Since the primary crystal α-Al is crystallized by applying a pressure to the Al—Si alloy melt during a process of cooling the melt to obtain a microcrystalline structure, the crystallization range of Si becomes significantly narrower and the Si is refined, resulting in an Al—Si alloy with improved mechanical characteristics.

Casting Using Melt in which Primary Crystal α-Al Has Been Formed

The method for the production of a microcrystalline Al—Si alloy that is described in the above example is applicable to casting and forging. Some specific application examples are described below.

First, a casting method is described in which casting is carried out utilizing the nonequilibrium α-Al grains that are formed (crystallized) in the Al—Si alloy melt during the process of sono-solidification of the melt as described before. While a microstructure as shown in FIG. 3A, FIG. 3B and FIG. 3C can be obtained by sono-solidification of an Al-18 Si alloy melt (730° C.) under specific vibration conditions as described before, it is possible to produce a casting (casting product) that has such a microstructure by employing the same method as described above in casting.

A main flow of the method for the production of a microcrystalline Al—Si alloy casting according to this embodiment includes a melting step in which an Al—Si alloy is melted to obtain an Al—Si alloy melt, a pressure applying step in which a pressure is applied to the melt during a process of cooling the melt, and a casting step in which casting of an Al—Si alloy casting is carried out using the melt in which primary crystal α-Al has been formed during the cooling process. The melting step and the pressure applying step in the flow are the same as those in the method for the production of a microcrystalline Al—Si alloy that has been described before. A melt purifying step in which degassing of the melt or removal of impurities (slag removal) is carried out may be provided between the melting step and the pressure applying step.

First, the apparatus to which the method for the production of an Al—Si alloy casting is applied is required to be equipped with the apparatus 10, which has been described before, or an ultrasonic vibration apparatus that has the same configuration as the apparatus 10, and a casting device for the intended purpose such as centrifugal casting or die casting or a forging device (casting/forging process). The ultrasonic vibration apparatus and the casting device may be integrally constituted so that the production of the casting can continuously be carried out.

In the casting step, the melt that has been through the sono-solidification process is teemed into a specified mold, and the mold is cooled under specified cooling conditions (such as a condition to quench (cool with water) the mold). Examples of the casting method for use in the casting step include die casting and centrifugal casting. That is, in the casting step, casting is carried out by teeming the melt that has been through the sono-solidification process by the ultrasonic vibration apparatus (melt in which nuclei of the primary crystal α-Al have been formed) into a mold.

Flows of some application examples are shown below. The steps in each flow primarily correspond to the steps that have been described before (melting step→melt purifying step→pressure applying step→casting step), and their description are not repeated.

Application Example 1

Fine Si Surface Crystallization Method

Melting an Al-18 Mass % Si at 730° C.→Purifying the Melt (Degassing, Slag Removal)→Applying Ultrasonic Vibration (20 kHz, 20 μm)→Centrifugal Casting after 578° C. is Reached.

Application Example 2

High-Strength Casting Production Method

Melting an Al-18 Mass % Si at 730° C.→Purifying the Melt (Degassing, Slag Removal)→Applying Ultrasonic Vibration (20 kHz, 20 μm)→Die-Casting after the Temperature Reaches 578° C.

When Application Example 1 is employed, the crystallized primary crystal Si moves toward the center (inside) of the casting as shown in FIG. 3A. As a result, abrasion resistance can be imparted to a desired portion of a member that has a sliding surface therein, for example, a member that has a sliding surface such as a cylinder block. When Application Example 2 is employed, the existence of the crystallized primary crystal Si increases the strength of the casting structure as shown in FIG. 3A.

Application Example 3

Production of Abrasion-Resistant Material on which the Gradient Si Layer is Deposited Melting an Al-18 Mass % Si at 730° C.→Purifying the Melt (Degassing, Slag Removal)→Applying Ultrasonic Vibration (20 kHz, 20 μm)→Centrifugal Casting after 577° C. is Reached.

Application Example 4

Thixomolding

Melting an Al-18 Mass % Si at 730° C.→Purifying the Melt (Degassing, Slag Removal)→Applying Ultrasonic Vibration (20 kHz, 20 μm)→Die Casting after 577° C. is Reached.

When Application Example 3 is employed, the crystallized primary crystal Si moves toward the center (inside) of the casting as shown in FIG. 3B, and the eutectic Si further moves toward the center (inside) of the casting as compared with Application Example 1. As a result, the higher abrasion resistance can be imparted to a desired portion of a member that has a sliding surface therein, for example, a member that has a sliding surface such as a cylinder block, as compared with the case where Application Example 1 is employed. When Application Example 4 is employed, a thixomolding material that has a thixotropic effect can be obtained.

Application Example 5

Production of High Strength Al Forging Product

Melting an Al-18 Mass % Si at 730° C.→Purifying the Melt (Degassing, Slag Removal)→Applying Ultrasonic Vibration (20 kHz, 20 μm)→Waiting for 20 Seconds after 577° C. is Reached→Forging.

Application Example 6

Production of Billet for Semisolid Forming

Melting an Al-18 Mass % Si at 730° C.→Purifying the Melt (Degassing, Slag Removal)→Applying Ultrasonic Vibration (20 kHz, 20 μm)→Waiting for 20 Seconds after 577° C. is Reached→Quenching.

When Application Example 5 is employed, a forging product that has a microstructure as shown in FIG. 3C is achieved. As a result, a high-strength forging product can be obtained. When Application Example 6 is employed, a high-strength casting product can be obtained by remelting the billet for semisolid forming and carrying out semisolid casting.

As described in the above Application Examples, it is possible to provide a casting product or forging product with further improved mechanical characteristics by effectively utilizing the crystal in which primary crystal Si or the like has been crystallized.

When a metal melt in the cooling process is solidified under ultrasonic vibration (sono-solidified), the microstructure is refined and improvement of the mechanical properties can be expected. Since refinement of crystal grains is almost synonymous with increase in the number of solidification nuclei, stirring of the melt, in other words, ultrasonic acoustic stream, promotes separation of crystal nuclei from the mold wall surfaces, which contributes to the increase in the number of crystal nuclei. In addition, as described above, when a hypoeutectic or hypereutectic Al—Si alloy melt was sono-solidified, refinement of α-Al phase or Si grains in the primary crystal was observed. Moreover, in the microstructure obtained by sono-solidifying a hypereutectic Al—Si alloy melt, crystallization of the nonequilibrium α-Al phase, which cannot be predictable from the equilibrium diagram, was observed in addition to the refined primary crystal Si grains. Therefore, when a hypoeutectic or hypereutectic Al—Si alloy melt is sono-solidified, refinement of Si grains is achieved in either case, and the resulting alloy has improved mechanical characteristics, in particular, improved abrasion resistance. As the ingot that is used as the melt, a hypereutectic Al—Si alloy is more preferred than a hypoeutectic Al—Si alloy for better abrasion resistance in terms of Si content.

Based on the assumption that generation and collapse of ultrasonic cavitation bubbles plays a critical role in crystallization of the nonequilibrium α-Al phase, an experiment was conducted in which melts in the process of sono-solidification were quenched in water to find its crystallization mechanism. As a result, it was found possible to produce an alloy that has excellent mechanical characteristics by utilizing the crystallization mechanism.

The production method for obtaining a microcrystalline structure that has been described in this embodiment is not limited to the application to Al—Si alloys, and it is possible to create a microcrystalline structure in other alloys, such as Al—Mg and Mg—Zn binary and ternary alloys, by applying the production method according to the present invention. Note that, in a Mg—Zn alloy, a fine primary crystal is α-Mg. Examples of an Al—Mg alloy include not only a binary Al—Mg alloy but also a ternary alloy that contains Al, Mg and another metal. Examples of a Mg—Zn alloy include not only a binary Mg—Zn alloy but also a ternary alloy that contains Mg, Zn and another metal. In each of these alloys, a primary crystal is a generally spherical crystal.

A material that has improved abrasion resistance can be produced from a hypereutectic Al—Si (Si: 12% or higher) alloy melt. For example, members that requires less plating, surface coating or the like can be obtained by casting or forging.

Since an ultrasonic vibration apparatus is used as one example of the apparatus that applies pressure to the melt, a local pressure rise that is induced by the application of ultrasonic vibration occurs in the melt, and an eutectic point displacement effect (increase in eutectic temperature, increase in Si element saturation temperature) is obtained. As a result, primary crystal α-Al can be obtained easily, and the solidification structure can be controlled into any desired state.

When primary crystal α-Al or granular Si crystal which has been crystallized is solidified by a cooling step in which the melt is solidified by rapid quenching, a crystalline structure that has both abrasion resistance and high toughness (grain refining) can be obtained.

The invention claimed is:

1. A method for the production of an alloy that has a microcrystalline structure, comprising:

a melting step in which an alloy is melted to obtain an alloy melt;

a cooling step, during which a pressure is applied using ultrasonic cavitation that is generated in the alloy melt by applying ultrasonic vibration to the melt, to drop a temperature of the melt at or below an eutectic temperature of the alloy melt; and a quenching step in which the alloy melt is quenched after the temperature of the alloy melt is cooled at or below the eutectic temperature, thereby a nonequilibrium α-Al phase is crystallized, wherein the alloy is one of an Al—Si alloy and an Al—Mg alloy.

2. The production method according to claim 1, wherein the alloy is the Al—Si alloy or the Al—Mg alloy; and α-Al that is the fine primary crystal is crystallized in the pressure applying step.

3. The production method according to claim 2, wherein the alloy is the Al—Si alloy.

4. The production method according to claim 3, wherein the Al—Si alloy is hypereutectic.

5. An alloy that is produced by the production method according to claim 1.

6. The production method according to claim 1, wherein the applied pressure is 1 GPa or more.

* * * * *